US007640975B2

(12) United States Patent
Cavender et al.

(10) Patent No.: US 7,640,975 B2
(45) Date of Patent: Jan. 5, 2010

(54) FLOW CONTROL FOR INCREASED PERMEABILITY PLANES IN UNCONSOLIDATED FORMATIONS

(75) Inventors: Travis W. Cavender, Angleton, TX (US); Grant Hocking, London (GB); Roger L. Schultz, Ninnekah, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 73 days.

(21) Appl. No.: 11/832,615

(22) Filed: Aug. 1, 2007

(65) Prior Publication Data

US 2009/0032267 A1 Feb. 5, 2009

(51) Int. Cl.
*E21B 43/26* (2006.01)

(52) U.S. Cl. ..... 166/207; 166/242.1; 166/305.1; 166/381; 166/386

(58) Field of Classification Search ..... 166/227, 166/308.1, 381, 207, 242.1, 386, 206, 305.1
See application file for complete search history.

(56) References Cited

U.S. PATENT DOCUMENTS

| | | | | |
|---|---|---|---|---|
| 2,642,142 | A | | 6/1953 | Clark |
| 2,687,179 | A | | 8/1954 | Dismukes |
| 2,862,564 | A | * | 12/1958 | Bostock ..... 166/214 |
| 2,870,843 | A | | 1/1959 | Rodgers, Jr. |
| 3,058,730 | A | | 10/1962 | Bays |
| 3,062,286 | A | | 11/1962 | Wyllie |
| 3,071,481 | A | | 1/1963 | Beach et al. |
| 3,270,816 | A | | 9/1966 | Staadt |
| 3,280,913 | A | | 10/1966 | Smith |
| 3,338,317 | A | | 8/1967 | Shore |
| 3,690,380 | A | | 9/1972 | Grable |
| 3,727,688 | A | | 4/1973 | Clampitt |
| 3,779,915 | A | | 12/1973 | Kucera |

(Continued)

FOREIGN PATENT DOCUMENTS

CA 2543886 4/2006

(Continued)

OTHER PUBLICATIONS

Halliburton Retrievable Service Tools, Cobra Frac® RR4-EV Packer, (2 pgs.) undated.
U.S. Appl. No. 11/832,602, filed Aug. 1, 2007.
Halliburton Production Optimization, Cobra Frac® Service, (2 pgs.), dated Aug. 2005.

(Continued)

*Primary Examiner*—Giovanna C Wright
(74) *Attorney, Agent, or Firm*—Marlin R. Smith

(57) ABSTRACT

Flow control for increased permeability planes in unconsolidated formations. A well system includes a casing expansion device interconnected in a casing string for initiating an inclusion propagated into a formation surrounding the casing string. The device has at least one opening in a sidewall for fluid communication between the inclusion and an interior of the casing string. A flow control device is retrievably installed in the expansion device and controls flow between the formation and an interior of the casing string. A method of controlling flow of fluid between a formation and an interior of a casing string includes the steps of interconnecting a casing expansion device in the casing string; expanding the device to thereby initiate propagation of an inclusion into the formation; and installing a flow control device in the expansion device to thereby control flow between the inclusion and the casing string interior.

26 Claims, 4 Drawing Sheets

U.S. PATENT DOCUMENTS

| | | | | |
|---|---|---|---|---|
| 3,884,303 | A | 5/1975 | Closmann | |
| 3,948,325 | A | 4/1976 | Winston et al. | |
| 4,005,750 | A | 2/1977 | Shuck | |
| 4,018,293 | A | 4/1977 | Keller | |
| 4,311,194 | A | 1/1982 | White | |
| 4,834,181 | A | 5/1989 | Uhri et al. | |
| 4,977,961 | A | 12/1990 | Avasthi | |
| 5,010,964 | A | 4/1991 | Cornette | |
| 5,103,911 | A | 4/1992 | Heijnen | |
| 5,111,881 | A | 5/1992 | Soliman et al. | |
| 5,211,714 | A | 5/1993 | Jordan et al. | |
| 5,318,123 | A | 6/1994 | Venditto et al. | |
| 5,325,923 | A | 7/1994 | Surjaatmadja | |
| 5,335,724 | A | 8/1994 | Venditto et al. | |
| 5,372,195 | A | 12/1994 | Swanson et al. | |
| 5,386,875 | A | 2/1995 | Venditto et al. | |
| 5,394,941 | A | 3/1995 | Venditto et al. | |
| 5,396,957 | A | 3/1995 | Surjaatmadja | |
| 5,431,225 | A | 7/1995 | Abass et al. | |
| 5,472,049 | A | 12/1995 | Chaffee et al. | |
| 5,494,103 | A | 2/1996 | Surjaatmadja et al. | |
| 5,547,023 | A | 8/1996 | McDaniel et al. | |
| 5,564,499 | A | 10/1996 | Willis et al. | |
| 5,765,642 | A | 6/1998 | Surjaatmadja | |
| 5,829,520 | A | 11/1998 | Johnson | |
| 5,944,446 | A | 8/1999 | Hocking | |
| 5,981,447 | A | 11/1999 | Chang et al. | |
| 6,003,599 | A | 12/1999 | Huber et al. | |
| 6,116,343 | A | 9/2000 | Van Petegem et al. | |
| 6,176,313 | B1 | 1/2001 | Coenen et al. | |
| 6,216,783 | B1 | 4/2001 | Hocking et al. | |
| 6,283,216 | B1 | 9/2001 | Ohmer | |
| 6,330,914 | B1 | 12/2001 | Hocking et al. | |
| 6,443,227 | B1 | 9/2002 | Hocking et al. | |
| 6,446,727 | B1 | 9/2002 | Zemlak et al. | |
| 6,508,307 | B1 | 1/2003 | Almaguer | |
| 6,543,538 | B2 | 4/2003 | Tolman et al. | |
| 6,662,874 | B2 | 12/2003 | Surjaatmadja | |
| 6,719,054 | B2 | 4/2004 | Cheng et al. | |
| 6,725,933 | B2 | 4/2004 | Middaugh et al. | |
| 6,732,800 | B2 | 5/2004 | Acock et al. | |
| 6,779,607 | B2 | 8/2004 | Middaugh et al. | |
| 6,792,720 | B2 | 9/2004 | Hocking | |
| 6,991,037 | B2 | 1/2006 | Hocking | |
| 7,055,598 | B2 * | 6/2006 | Ross et al. | 166/236 |
| 7,066,284 | B2 | 6/2006 | Wylie et al. | |
| 7,069,989 | B2 | 7/2006 | Marmorshteyn | |
| 7,228,908 | B2 | 6/2007 | East, Jr. et al. | |
| 7,240,728 | B2 | 7/2007 | Cook et al. | |
| 7,278,484 | B2 | 10/2007 | Vella et al. | |
| 7,412,331 | B2 | 8/2008 | Calhoun et al. | |
| 2003/0230408 | A1 | 12/2003 | Acock et al. | |
| 2005/0263284 | A1 | 12/2005 | Justus | |
| 2006/0131074 | A1 | 6/2006 | Calhoun et al. | |
| 2006/0144593 | A1 | 7/2006 | Reddy | |
| 2007/0199695 | A1 | 8/2007 | Hocking | |
| 2007/0199697 | A1 | 8/2007 | Hocking | |
| 2007/0199698 | A1 | 8/2007 | Hocking | |
| 2007/0199699 | A1 | 8/2007 | Hocking | |
| 2007/0199700 | A1 | 8/2007 | Hocking | |
| 2007/0199701 | A1 | 8/2007 | Hocking | |
| 2007/0199702 | A1 | 8/2007 | Hocking | |
| 2007/0199704 | A1 | 8/2007 | Hocking | |
| 2007/0199705 | A1 | 8/2007 | Hocking | |
| 2007/0199706 | A1 | 8/2007 | Hocking | |
| 2007/0199707 | A1 | 8/2007 | Hocking | |
| 2007/0199708 | A1 | 8/2007 | Hocking | |
| 2007/0199710 | A1 | 8/2007 | Hocking | |
| 2007/0199711 | A1 | 8/2007 | Hocking | |
| 2007/0199712 | A1 | 8/2007 | Hocking | |
| 2007/0199713 | A1 | 8/2007 | Hocking | |

FOREIGN PATENT DOCUMENTS

| | | | |
|---|---|---|---|
| EP | 1131534 | | 9/2003 |
| WO | 8100015 | A1 | 1/1981 |
| WO | 0001926 | | 1/2000 |
| WO | 200029716 | | 5/2000 |
| WO | 2004092530 | A2 | 10/2004 |
| WO | 2005065334 | | 7/2005 |
| WO | 2007000956 | | 9/2007 |
| WO | 2007012175 | | 10/2007 |
| WO | 2007012199 | | 10/2007 |
| WO | 2007017787 | | 10/2007 |
| WO | 2007017810 | | 10/2007 |
| WO | 2007017865 | | 10/2007 |

OTHER PUBLICATIONS

Halliburton Drawing No. D00004932, (2 pgs), dated Sep. 10, 1999.
Serata Geomechanics Corporation, "Stress/Property Measurements for Geomechanics," www.serata.com, dated 2005-2007.
ISTT, "Trenchless Pipe Replacement," (1 pg), dated Dec. 11, 2006.
ISTT, "Rerounding" (2 pgs), dated Dec. 11, 2006.
STAR Frac Completion System brochure, (4 pgs.), dated Winter/Spring 2006.
Wenlu Zhu, et al., "Shear-enhanced Compaction and Permeability Reduction: Triaxial Extension Tests on Porous Sandstone," Mechanics of Materials, (16 pgs.) dated 1997.
S.L. Karner, "What Can Granular Media Teach Us About Deformation in Geothermal Systems?" ARMA, dated 2005.
M.R. Coop, "The Mechanics of Uncemented Carbonate Sands," Geotechnique vol. 40, No. 4, (pp. 607-626), dated 1990.
M.R. Coop and J.H. Atkinson, "The Mechanics of Cemented Carbonate Sands," Geotechnique vol. 43, No. 1, (pp. 53-67), dated 1993.
T. Cuccovillo and M.R. Coop, "Yielding and Pre-failure Deformation of Structured Sands," Geotechnique vol. 47, No. 3, (pp. 491-508), dated 1997.
Lockner and Stanchits, "Undrained Pore-elastic Response of Sandstones to Deviatoric Stress Change," Porelastic Response of Sandstones, (30 pgs.) dated 2002.
Axel Kaselow and Serge Shapiro, "Stress Sensitivity of Elastic Moduli and Electrical Resistivity in Porous Rocks," Journal of Geophysics and Engineering, dated Feb. 11, 2004.
Lockner and Beeler, "Stress-Induced Anisotropic Porelasticity Response in Sandstone," dated Jul. 2003.
G.V. Rotta, at al., "Isotropic Yielding in an Artificially Cemented Soil Cured Under Stress," Geotechnique, vol. 53, No. 53, (pp. 493-501), dated 2003.
T.F. Wong and P. Baud, "Mechanical Compaction of Porous Sandstone," Oil and Gas Science and Technology, (pp. 715-727), dated 1999.
U.S. Appl. No. 11/610,819, filed Dec. 14, 2006.
U.S. Appl. No. 11/966,212, filed Dec. 28, 2007.
U.S. Appl. No. 11/832,620, filed Aug. 1, 2007.
U.S. Appl. No. 11/545,749, filed Oct. 10, 2006.
U.S. Appl. No. 11/753,314, filed May 24, 2007.
U.S. Appl. No. 11/977,772, filed Oct. 26, 2007.
International Search Report and Written Opinion issued Oct. 8, 2008, for International Patent Application No. PCT/US08/070780, 8 pages.
International Search Report and Written Opinion issued Sep. 25, 2008, for International Patent Application No. PCT/US07/87291, 11 pages.
Office Action issued Feb. 2, 2009, for Canadian Patent Application Serial No. 2,596,201, 3 pages.
Office Action issued May 15, 2009, for U.S. Appl. No. 11/610,819, 26 pages.
Office Action issued Jun. 17, 2009, for U.S. Appl. No. 11/832,620, 37 pages.
Office Action issued Jun. 16, 1009, for U.S. Appl. No. 11/832,602, 37 pages.

* cited by examiner

FLOW CONTROL FOR INCREASED PERMEABILITY PLANES IN UNCONSOLIDATED FORMATIONS

BACKGROUND

The present invention relates generally to equipment utilized and operations performed in conjunction with a subterranean well and, in an embodiment described herein, more particularly provides flow control for increased permeability planes in unconsolidated formations.

Recent advancements have been made in the art of forming increased permeability drainage planes in unconsolidated, weakly cemented formations. These advancements are particularly useful for enhancing production of hydrocarbons from relatively shallow tar sands, heavy oil reservoirs, etc., although the advancements have other uses, as well.

In some circumstances, it is desirable to complete such wells "tubingless," i.e., without using production tubing in a casing string to conduct fluid produced from the wells. Instead, the fluid is produced through the casing string. In those circumstances, conventional flow controls, well screens, testing devices, etc. typically used with production tubing strings cannot be utilized. Other circumstances can also prompt a need for flow control in a casing string.

Therefore, it will be appreciated that improvements are needed in the art of flow control in wells.

SUMMARY

In carrying out the principles of the present invention, well systems and associated devices and methods are provided which solve at least one problem in the art. One example is described below in which flow between a formation and an interior of a casing string is conveniently controlled using a device installed in the casing string. Another example is described below in which the device is particularly well suited for use in conjunction with unconsolidated, weakly cemented formations.

In one aspect, a well system is provided which includes a casing expansion device interconnected in a casing string for initiating at least one inclusion propagated into a formation surrounding the casing string. The expansion device has at least one opening in a sidewall for fluid communication between the inclusion and an interior of the casing string. A flow control device is retrievably installed in the expansion device, and controls flow of fluid between the formation and an interior of the casing string.

In another aspect, a method of controlling flow of fluid between a formation and an interior of a casing string is provided. The method includes the steps of: interconnecting a casing expansion device in the casing string; expanding the expansion device to thereby initiate propagation of at least one inclusion into the formation; and installing a flow control device in the expansion device to thereby control flow of the fluid between the inclusion and the interior of the casing string.

These and other features, advantages, benefits and objects will become apparent to one of ordinary skill in the art upon careful consideration of the detailed description of representative embodiments of the invention hereinbelow and the accompanying drawings, in which similar elements are indicated in the various figures using the same reference numbers.

DETAILED DESCRIPTION

It is to be understood that the various embodiments of the present invention described herein may be utilized in various orientations, such as inclined, inverted, horizontal, vertical, etc., and in various configurations, without departing from the principles of the present invention. The embodiments are described merely as examples of useful applications of the principles of the invention, which is not limited to any specific details of these embodiments.

In the following description of the representative embodiments of the invention, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore.

Figure 1:
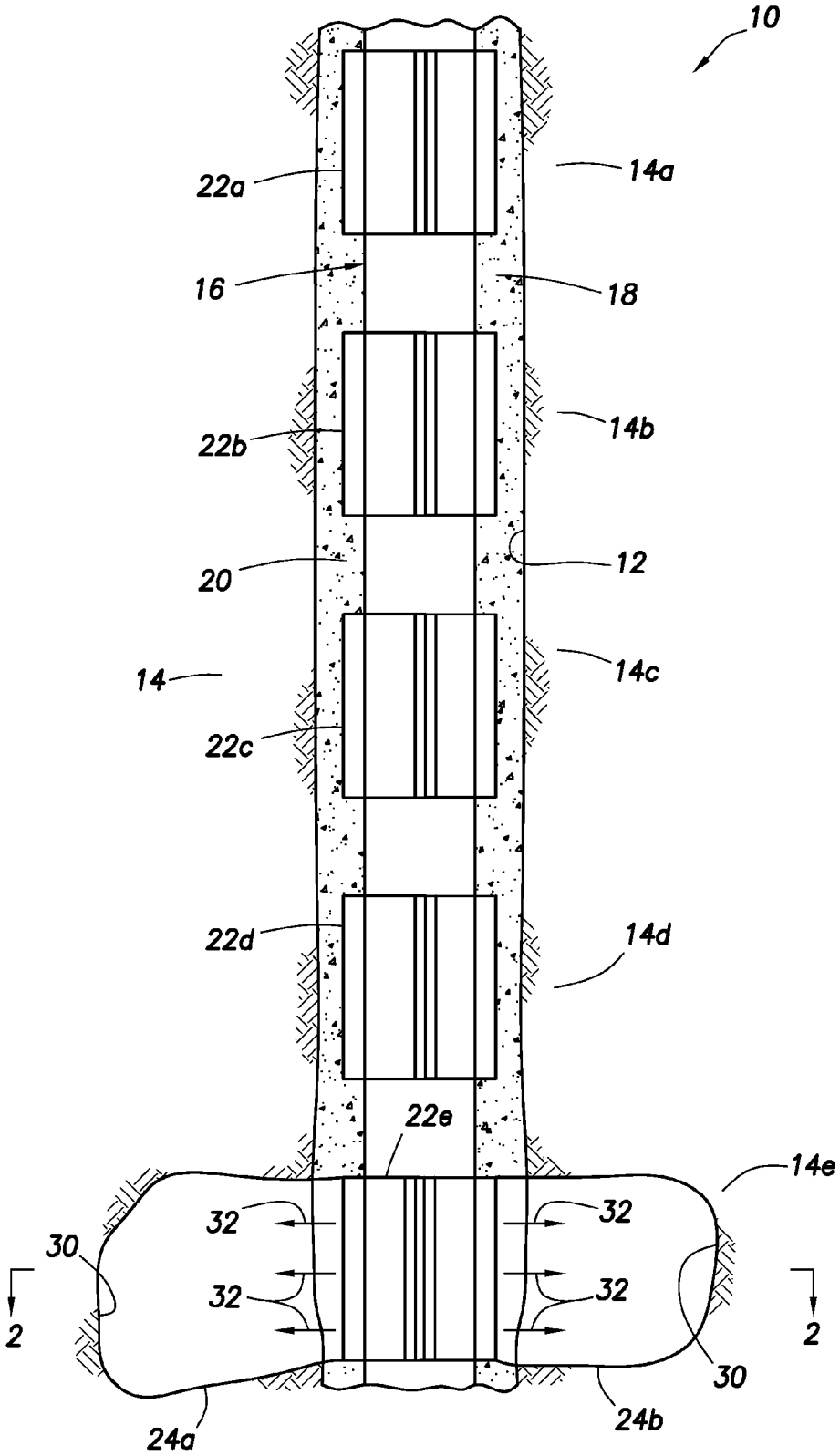
FIG. 1 is a schematic partially cross-sectional view of a well system and associated method embodying principles of the present invention.

Representatively illustrated in FIG. 1 is a well system 10 and associated method which embody principles of the present invention. In the system 10, a wellbore 12 has been drilled intersecting a subterranean formation 14. Although the wellbore 12 is depicted in FIG. 1 as being substantially vertical, the wellbore in other embodiments could be horizontal, inclined, deviated or otherwise oriented.

The formation 14 includes several zones 14*a-e* penetrated by the wellbore 12. Alternatively, one or more of the zones 14*a-e* could be in separate formations, part of other reservoirs, etc.

A casing string 16 is installed in the wellbore 12. As used herein, the term "casing" refers to any form of protective lining for a wellbore (such as those linings known to persons skilled in the art as "casing" or "liner", etc.), made of any material or combination of materials (such as metals, polymers or composites, etc.), installed in any manner (such as by cementing in place, expanding, etc.) and whether continuous or segmented, jointed or unjointed, threaded or otherwise joined, etc.

Cement or another sealing material 18 has been flowed into an annulus 20 between the wellbore 12 and the casing string 16. The sealing material 18 is used to seal and secure the casing string 16 within the wellbore 12. Preferably, the sealing material 18 is a hardenable material (such as cement, epoxy, etc.) which may be flowed into the annulus 20 and allowed to harden therein, in order to seal off the annulus and secure the casing 16 in position relative to the wellbore 12. However, other types of materials (such as swellable materials conveyed into the wellbore 12 on the casing string 16, etc.) may be used, without departing from the principles of the invention.

As depicted in FIG. 1, the casing string 16 includes multiple casing expansion devices 22 (indicated individually as elements 22*a-e* in FIG. 1). In the system 10, each of the expansion devices 22*a-e* corresponds to one of the respective zones 14*a-e*. However, it should be clearly understood that it is not necessary in keeping with the principles of the invention for there to be multiple expansion devices or multiple zones, or for each expansion device to correspond with a respective zone.

The expansion devices 22*a-e* operate to expand the casing string 16 radially outward and thereby dilate the formation 14 proximate the devices, in order to initiate forming of generally vertical and planar inclusions 24 (indicated individually in FIGS. 1 & 2 as elements 24*a-d*) extending outwardly from the wellbore 16. As illustrated in FIG. 1, this operation has been performed using the lowermost expansion device 22*e*.

Suitable expansion devices for use in the well system 10 are described in U.S. Pat. Nos. 6,991,037, 6,792,716, 6,216,783, 6,330,914, 6,443,227 and their progeny, and in U.S. patent application Ser. No. 11/610,819. The entire disclosures of these prior patents and patent applications are incorporated herein by this reference. Other expansion devices may be used in the well system 10 in keeping with the principles of the invention.

Once the devices 22*a-e* are operated to expand the casing string 16 radially outward, fluid 32 is forced into the dilated formation 14 to propagate the inclusions 24*a-d* into the formation. It is not necessary for the inclusions 24*a-d* to be formed simultaneously. Furthermore, the devices 22*a-e* could be operated individually, simultaneously or in any combination.

The formation 14 could be comprised of relatively hard and brittle rock, but the system 10 and method find especially beneficial application in ductile rock formations made up of unconsolidated or weakly cemented sediments, in which it is typically very difficult to obtain directional or geometric control over inclusions 24 as they are being formed.

Weakly cemented sediments are primarily frictional materials since they have minimal cohesive strength. An uncemented sand having no inherent cohesive strength (i.e., no cement bonding holding the sand grains together) cannot contain a stable crack within its structure and cannot undergo brittle fracture. Such materials are categorized as frictional materials which fail under shear stress, whereas brittle cohesive materials, such as strong rocks, fail under normal stress.

The term "cohesion" is used in the art to describe the strength of a material at zero effective mean stress. Weakly cemented materials may appear to have some apparent cohesion due to suction or negative pore pressures created by capillary attraction in fine grained sediment, with the sediment being only partially saturated. These suction pressures hold the grains together at low effective stresses and, thus, are often called apparent cohesion.

The suction pressures are not true bonding of the sediment's grains, since the suction pressures would dissipate due to complete saturation of the sediment. Apparent cohesion is generally such a small component of strength that it cannot be effectively measured for strong rocks, and only becomes apparent when testing very weakly cemented sediments.

Geological strong materials, such as relatively strong rock, behave as brittle materials at normal petroleum reservoir depths, but at great depth (i.e. at very high confining stress) or at highly elevated temperatures, these rocks can behave like ductile frictional materials. Unconsolidated sands and weakly cemented formations behave as ductile frictional materials from shallow to deep depths, and the behavior of such materials are fundamentally different from rocks that exhibit brittle fracture behavior. Ductile frictional materials fail under shear stress and consume energy due to frictional sliding, rotation and displacement.

Conventional hydraulic dilation of weakly cemented sediments is conducted extensively on petroleum reservoirs as a means of sand control. The procedure is commonly referred to as "Frac-and-Pack." In a typical operation, the casing is perforated over the formation interval intended to be fractured and the formation is injected with a treatment fluid of low gel loading without proppant, in order to form the desired two winged structure of a fracture. Then, the proppant loading in the treatment fluid is increased substantially to yield tip screen-out of the fracture. In this manner, the fracture tip does not extend further, and the fracture and perforations are backfilled with proppant.

The process assumes a two winged fracture is formed as in conventional brittle hydraulic fracturing. However, such a process has not been duplicated in the laboratory or in shallow field trials. In laboratory experiments and shallow field trials what has been observed is chaotic geometries of the injected fluid, with many cases evidencing cavity expansion growth of the treatment fluid around the well and with deformation or compaction of the host formation.

Weakly cemented sediments behave like a ductile frictional material in yield due to the predominantly frictional behavior and the low cohesion between the grains of the sediment. Such materials do not "fracture" and, therefore, there is no inherent fracturing process in these materials as compared to conventional hydraulic fracturing of strong brittle rocks.

Linear elastic fracture mechanics is not generally applicable to the behavior of weakly cemented sediments. The knowledge base of propagating viscous planar inclusions in weakly cemented sediments is primarily from recent experience over the past ten years and much is still not known regarding the process of viscous fluid propagation in these sediments.

However, the present disclosure provides information to enable those skilled in the art of hydraulic fracturing, soil and rock mechanics to practice a method and system 10 to initiate and control the propagation of a viscous fluid in weakly cemented sediments. The viscous fluid propagation process in these sediments involves the unloading of the formation 14 in the vicinity of the tip 30 of the propagating viscous fluid 32, causing dilation of the formation, which generates pore pressure gradients towards this dilating zone. As the formation 14 dilates at the tips 30 of the advancing viscous dilation fluid 32, the pore pressure decreases dramatically at the tips, resulting in increased pore pressure gradients surrounding the tips.

The pore pressure gradients at the tips 30 of the inclusions 24*a-d* result in the liquefaction, cavitation (degassing) or fluidization of the formation 14 immediately surrounding the tips. That is, the formation 14 in the dilating zone about the tips 30 acts like a fluid since its strength, fabric and in situ stresses have been destroyed by the fluidizing process, and this fluidized zone in the formation immediately ahead of the viscous fluid 32 propagating tip 30 is a planar path of least resistance for the viscous fluid to propagate further. In at least this manner, the system 10 and associated method provide for directional and geometric control over the advancing inclusions 24*a-d*.

The behavioral characteristics of the viscous fluid 32 are preferably controlled to ensure the propagating viscous fluid does not overrun the fluidized zone and lead to a loss of control of the propagating process. Thus, the viscosity of the fluid 32 and the volumetric rate of injection of the fluid should be controlled to ensure that the conditions described above persist while the inclusions 24*a-d* are being propagated through the formation 14.

For example, the viscosity of the fluid 32 is preferably greater than approximately 100 centipoise. However, if foamed fluid 32 is used in the system 10 and method, a greater range of viscosity and injection rate may be permitted while still maintaining directional and geometric control over the inclusions 24*a-d*.

The system 10 and associated method are applicable to formations of weakly cemented sediments with low cohesive strength compared to the vertical overburden stress prevailing at the depth of interest. Low cohesive strength is defined herein as no greater than 400 pounds per square inch (psi) plus 0.4 times the mean effective stress (p') at the depth of propagation.

$$c<400\text{ psi}+0.4\,p' \quad (1)$$

where c is cohesive strength and p' is mean effective stress in the formation 14.

Examples of such weakly cemented sediments are sand and sandstone formations, mudstones, shales, and siltstones, all of which have inherent low cohesive strength. Critical state soil mechanics assists in defining when a material is behaving as a cohesive material capable of brittle fracture or when it behaves predominantly as a ductile frictional material.

Weakly cemented sediments are also characterized as having a soft skeleton structure at low effective mean stress due to the lack of cohesive bonding between the grains. On the other hand, hard strong stiff rocks will not substantially decrease in volume under an increment of load due to an increase in mean stress.

In the art of poroelasticity, the Skempton B parameter is a measure of a sediment's characteristic stiffness compared to the fluid contained within the sediment's pores. The Skempton B parameter is a measure of the rise in pore pressure in the material for an incremental rise in mean stress under undrained conditions.

In stiff rocks, the rock skeleton takes on the increment of mean stress and thus the pore pressure does not rise, i.e., corresponding to a Skempton B parameter value of at or about 0. But in a soft soil, the soil skeleton deforms easily under the increment of mean stress and, thus, the increment of mean stress is supported by the pore fluid under undrained conditions (corresponding to a Skempton B parameter of at or about 1).

The following equations illustrate the relationships between these parameters:

$$\Delta u=B\,\Delta p \quad (2)$$

$$B=(K_u-K)/(\alpha K_u) \quad (3)$$

$$\alpha=1-(K/K_s) \quad (4)$$

where Δu is the increment of pore pressure, B the Skempton B parameter, Δp the increment of mean stress, $K_u$ is the undrained formation bulk modulus, K the drained formation bulk modulus, α is the Biot-Willis poroelastic parameter, and $K_s$ is the bulk modulus of the formation grains. In the system 10 and associated method, the bulk modulus K of the formation 14 is preferably less than approximately 750,000 psi.

For use of the system 10 and method in weakly cemented sediments, preferably the Skempton B parameter is as follows:

$$B>0.95\exp(-0.04\,p')+0.008\,p' \quad (5)$$

The system 10 and associated method are applicable to formations of weakly cemented sediments (such as tight gas sands, mudstones and shales) where large entensive propped vertical permeable drainage planes are desired to intersect thin sand lenses and provide drainage paths for greater gas production from the formations. In weakly cemented formations containing heavy oil (viscosity >100 centipoise) or bitumen (extremely high viscosity >100,000 centipoise), generally known as oil sands, propped vertical permeable drainage planes provide drainage paths for cold production from these formations, and access for steam, solvents, oils, and heat to increase the mobility of the petroleum hydrocarbons and thus aid in the extraction of the hydrocarbons from the formation. In highly permeable weak sand formations, permeable drainage planes of large lateral length result in lower drawdown of the pressure in the reservoir, which reduces the fluid gradients acting towards the wellbore, resulting in less drag on fines in the formation, resulting in reduced flow of formation fines into the wellbore.

Although the present invention contemplates the formation of permeable drainage paths which generally extend laterally away from a vertical or near vertical wellbore 12 penetrating an earth formation 14 and generally in a vertical plane in opposite directions from the wellbore, those skilled in the art will recognize that the invention may be carried out in earth formations wherein the permeable drainage paths can extend in directions other than vertical, such as in inclined or horizontal directions. Furthermore, it is not necessary for the planar inclusions 24*a-d* to be used for drainage, since in some circumstances it may be desirable to use the planar inclusions exclusively for injecting fluids into the formation 14, for forming an impermeable barrier in the formation, etc.

Figure 2:
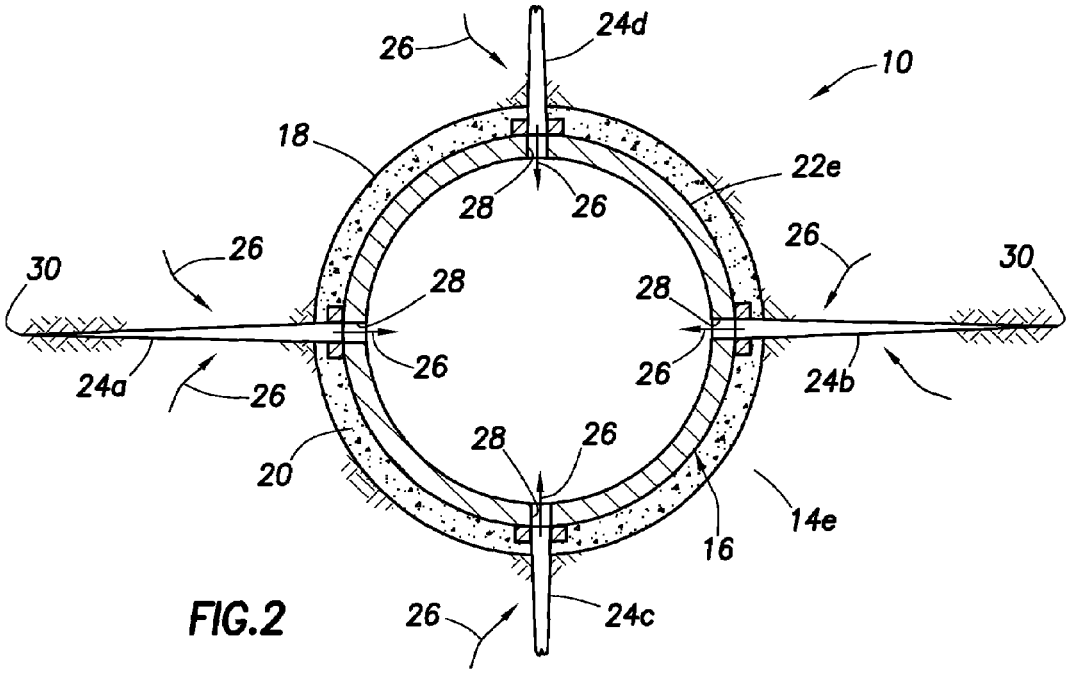
FIG. 2 is an enlarged scale schematic cross-sectional view through an expansion device in the well system, taken along line 2-2 of FIG. 1.

Referring additionally now to FIG. 2, a schematic cross-sectional view of the well system 10 is representatively illustrated after the step of propagating the inclusions 24*a-d* into the formation 14, and during production of fluid 26 into the interior of the casing string 16 from the formation via openings 28 in a sidewall of the expansion device 22*e*. Prior to or during the propagating step, the expansion device 22*e* is expanded radially outward to open the openings 28 and initiate formation of the inclusions 24*a-d*.

Although four of the inclusions 24*a-d* at 90 degree phasing are depicted in FIG. 2, any number of inclusions could be formed at any desired phasing in keeping with the principles of the invention. The inclusions 24*a-d* could all be simultaneously initiated, or they could be individually initiated, or any combination of the inclusions could be initiated together.

In FIG. 2, it may be seen that the inclusions 24*a-d* are propagated into the zone 14*e*. In a similar manner, inclusions propagated from the expansion device 22*a* would be formed in the zone 14*a*, inclusions propagated from the expansion device 22*b* would be formed in the zone 14*b*, etc. In one beneficial feature of the well system 10, the flow of fluid between the interior of the casing string 16 and each of the zones 14*a-e* can be individually controlled, regulated, sensed, etc., as described more fully below.

Figure 3:
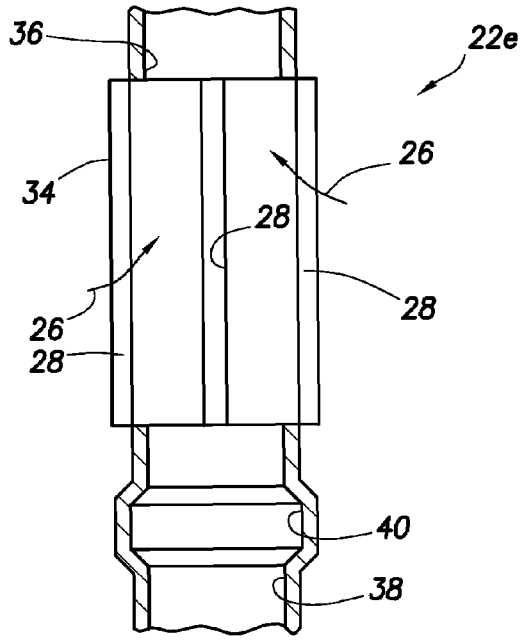
FIG. 3 is a schematic cross-sectional view of the expansion device which embodies principles of the present invention.

Referring additionally now to FIG. 3, a schematic cross-sectional view of the expansion device 22*e* is representatively illustrated in its expanded configuration apart from the remainder of the well system 10. In this view it may be seen that the expansion device 22*e* includes an outwardly expanded middle portion 34 having the longitudinally extending openings 28 which provide for fluid communication through the sidewall of the expansion device.

Straddling the middle expansion portion 34 are two seal bores 36, 38. In addition, an internal latch profile 40 is provided below the expansion portion 34. Note that other configurations of these elements could be used in keeping with the principles of the invention. For example, the seal bore 38 could be above the latch profile 40, the latch profile could be above the expansion portion 34, etc.

Figure 4:
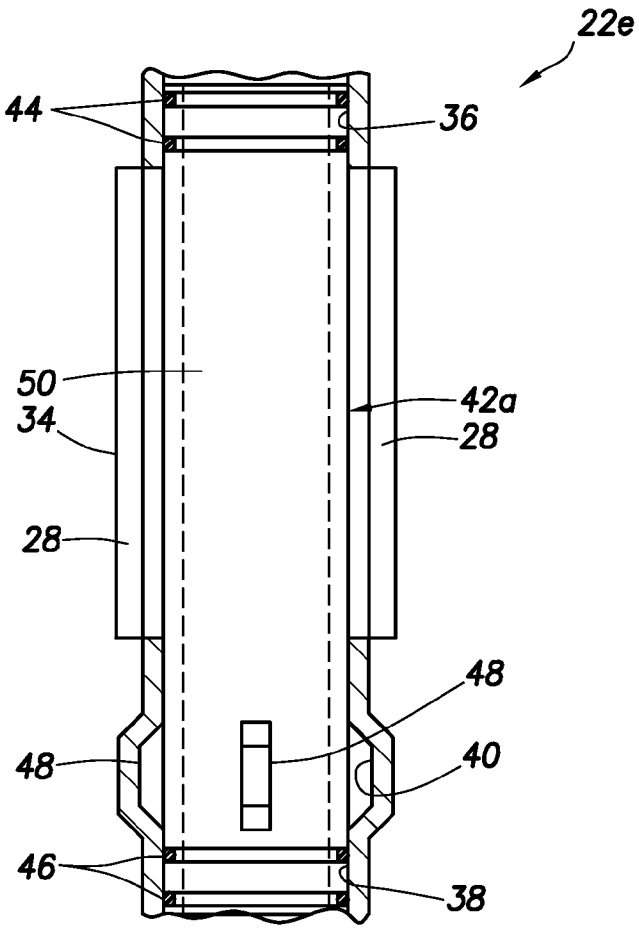
FIG. 4 is a schematic partially cross-sectional view of the expansion device with an isolation device installed therein.

Referring additionally now to FIG. 4, the expansion device 22*e* is depicted with a flow control device 42 installed therein. Different configurations of the flow control device 42 are indicated in FIGS. 4-7 as elements 42*a-d*. The flow control device 42*a* depicted in FIG. 4 may be conveyed into the expansion device 22*e* by any means, such as, wireline, slickline, coiled tubing, jointed pipe, etc.

The flow control device 42*a* includes seals 44, 46 for sealing engagement with the respective seal bores 36, 38 straddling the openings 28. Alternatively, the seals 44, 46 could be carried on the expansion device 22*e* for sealing engagement with seal surfaces on the flow control device 42*a*. Any type of seals may be used, such as elastomeric, non-elastomeric, metal-to-metal, expanding, etc.

The flow control device 22*e* also includes a set of keys or dogs 48 for cooperative engagement with the profile 40. This engagement releasably secures the flow control device 22*e* in position in the expansion device 22*e* in the casing string 16. The flow control device 42*a* can be later retrieved from the well, repositioned in another expansion device and/or reinstalled in the same expansion device 22*e*.

The flow control device 42*a* also includes a cylindrical middle portion 50 extending between the seals 44, 46. This middle portion 50 is used to prevent flow of the fluid 26 through the openings 28 when the flow control device 42*a* is installed in the expansion device 22*e*.

In this manner, fluid communication between the zone 14*e* and the interior of the casing string 16 can be selectively prevented or permitted by either installing or retrieving the flow control device 42*a*. Similarly, fluid communication between any of the other zones 14*a-d* and the interior of the casing string 16 can be selectively prevented or permitted as desired by installing or retrieving suitable flow control devices in the respective expansion devices 22*a-d*.

Thus, it will be appreciated that use of the flow control device 42*a* provides for selective production from, or injection into, the zones 14*a-e*. This may be useful, for example, to shut off water or gas producing zones, for steam flood or water flood conformance, to balance production from a reservoir in order to prevent water or gas coning, etc. Preferably, the flow control device 42*a* has a generally tubular shape, so that fluid communication and access is permitted longitudinally through the flow control device.

Figure 5:
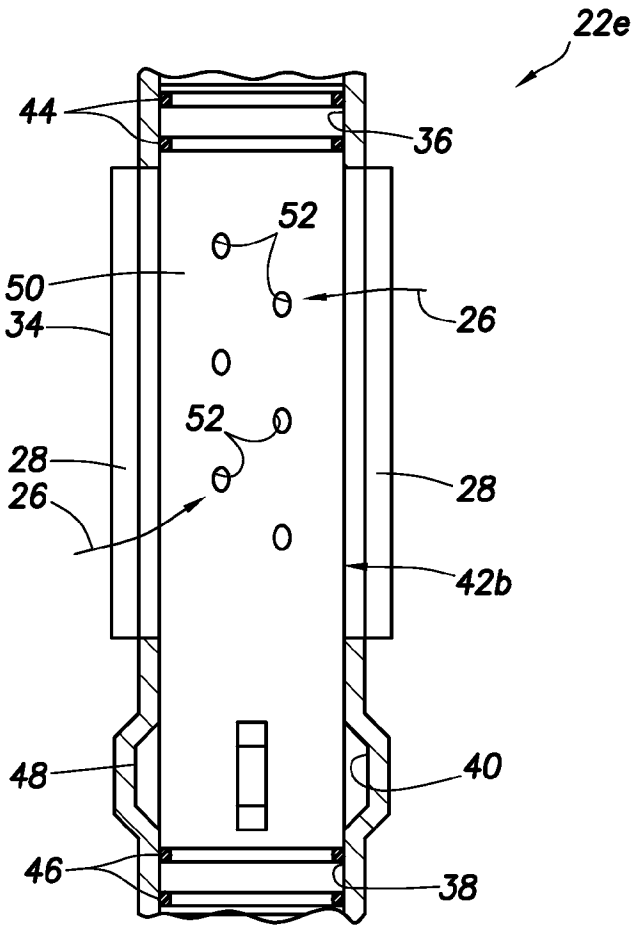
FIG. 5 is a schematic partially cross-sectional view of the expansion device with a flow regulating device installed therein.

Referring additionally now to FIG. 5, another flow control device 42*b* is shown installed in the expansion device 22*e*. This flow control device 42*b* includes orifices or other types of flow restrictors 52 in the middle portion 50 to choke or regulate flow of the fluid 26 through the openings 28 between the formation 14 and the interior of the casing string 16.

The flow control device 42*b* may be installed in selected ones of the expansion devices 22*a-e* to thereby selectively regulate flow between the corresponding zones 14*a-e* and the interior of the casing string 16. Use of the flow control device 42*b* may be beneficial in balancing production from, or injection into, the formation 14, for steam flood or water flood conformance, etc.

Various different numbers and sizes of the flow restrictors 52 may be used to achieve corresponding variations in restriction to flow of the fluid 26. Various types of flow restrictors, such as those known to persons skilled in the art as "inflow control devices," may be used in place of or in addition to orifices if desired.

Figure 6:
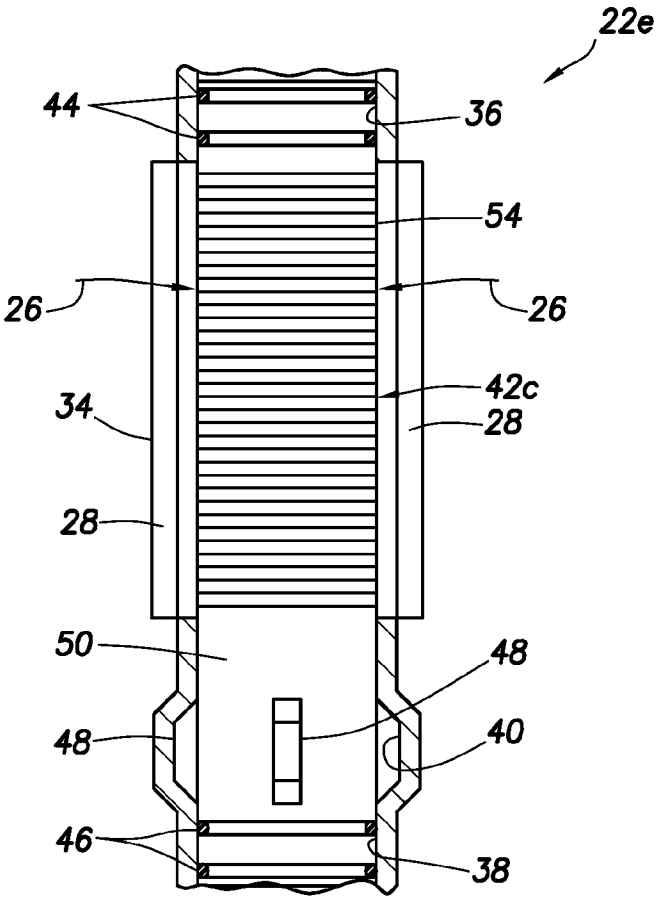
FIG. 6 is a schematic partially cross-sectional view of the expansion device with a fluid filtering device installed therein.

Referring additionally now to FIG. 6, another flow control device 42*c* is shown installed in the expansion device 22*e*. This flow control device 42*c* includes a filter 54 which filters the fluid 26 after it passes through the openings 28.

The filter 54 may be useful to prevent formation fines, proppant or gravel from being carried with the fluid 26 into the interior of the casing string 16. The filter 54 may be of the type used in conventional well screens (e.g., wire-wrapped, sintered metal, prepacked, etc.), or the filter may be similar to slotted or perforated liners.

Flow restrictors (such as those described above for the flow control device 42*b*, inflow control devices, orifices, etc.) may be used in combination with the filter 54 in order to provide both functions (fluid filtering and flow regulating) in a single flow control device.

Figure 7:
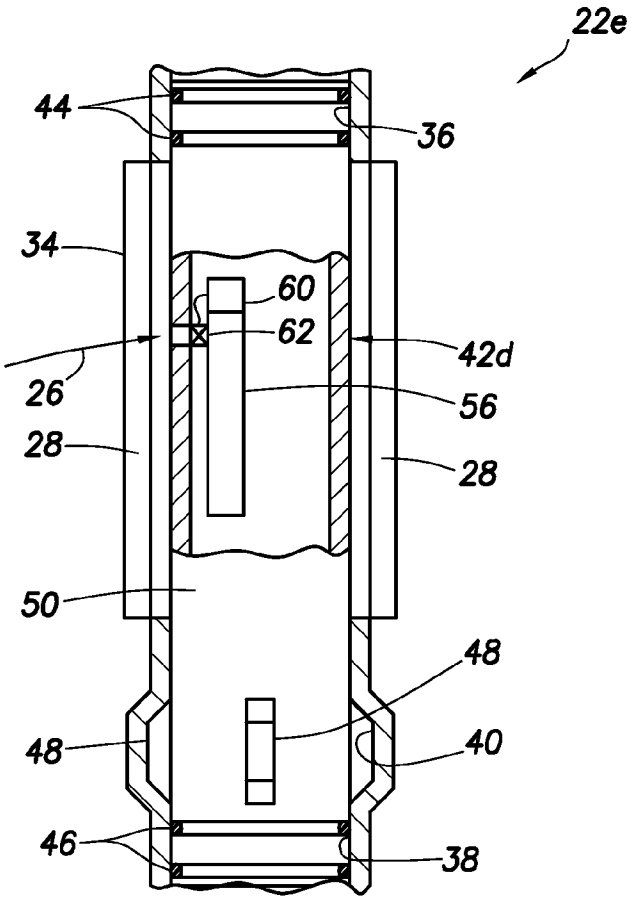
FIG. 7 is a schematic partially cross-sectional view of the expansion device with a formation testing device installed therein.

Referring additionally now to FIG. 7, another flow control device 42*d* is shown installed in the expansion device 22*e*. This flow control device 42*d* prevents the fluid 26 from flowing into the interior of the casing string 16, similar to the flow control device 42*a* described above. However, the flow control device 42*d* also includes one or more sensors 56 in the middle portion 50.

The sensors 56 are preferably exposed to the fluid 26 through a sidewall of the middle portion 50 as depicted in FIG. 7. However, other positions of the sensors 56 (such as externally relative to the middle portion 50, etc.) and other means for providing fluid communication with the openings 28, or at least contact with the fluid 26, may be used in keeping with the principles of the invention.

The sensors 56 may include pressure, temperature, resistivity, capacitance, flow rate, water or gas cut, fluid identification, or any other type or combination of sensors. The sensors 56 may include optical, electrical, mechanical, chemical or other means for sensing properties of the fluid 26 and/or the surrounding formation 14. The sensors 56 may include means for recording and/or transmitting indications of the sensed properties.

One benefit of the configuration illustrated in FIG. 7 is that a formation test (including buildup and drawdown tests) may be performed on the formation 14 without the need to compensate for wellbore storage effects, since the formation is isolated from the interior of the casing string 16 by the flow control device 42*d*. Valves, flow restrictors, samplers and other components may be incorporated into the flow control device 42*d* to facilitate performance of the formation testing operation and retrieval of a formation fluid sample.

In particular, the flow control device 42*d* may include a timer 60 for operation of a valve 62 at appropriate times to control admission of fluid 26 to the sensors 56, samplers, etc., during a formation test. Alternatively, or in addition, the valve 62 may be operated in response to properties sensed by the sensors 56, for example, to open the valve when pressure stabilization is detected.

It may now be fully appreciated that the above detailed description provides many advances in the art, including the well system 10 which includes one or more casing expansion devices 22 interconnected in a casing string 16 for initiating at least one inclusion 24 propagated into a formation 14 surrounding the casing string. The expansion device 22 has at least one opening 28 in a sidewall for fluid communication between the inclusion 24 and an interior of the casing string 16. A flow control device 42 is retrievably installed in the expansion device 22. The flow control device 42 controls flow of fluid 26 between the formation 14 and an interior of the casing string 16.

The expansion device 22 may include an internal latching profile 40 for releasable engagement by the flow control device 42.

The flow control device 42 may prevent flow of fluid 26 through the opening 28, regulate flow of fluid through the opening and/or filter fluid which flows through the opening. The flow control device 42 may include one or more sensors 56 which sense at least one property of fluid 26 in the formation 14 via the opening 28.

The formation 14 may comprise weakly cemented sediment. The inclusion 24 may be propagated into a portion of the formation 14 having a bulk modulus of less than approximately 750,000 psi. The formation 14 may have a cohesive strength of less than 400 pounds per square inch plus 0.4 times a mean effective stress in the formation at the depth of the inclusion 24. The formation 14 may have a Skempton B parameter greater than $0.95\exp(-0.04\,p')+0.008\,p'$, where $p'$ is a mean effective stress at a depth of the inclusion 24.

Furthermore, a method of controlling flow of fluid 26 between a formation 14 and an interior of a casing string 16 is provided by the above detailed description. The method includes the steps of: interconnecting a casing expansion device 22 in the casing string 16; expanding the expansion device 22 to thereby initiate propagation of at least one inclusion 24 into the formation 14; and installing a flow control device 42 in the expansion device 22 to thereby control flow of the fluid 26 between the inclusion 24 and the interior of the casing string 16.

The installing step may be performed after the expanding step. The method may include retrieving the flow control device 42 from the expansion device 22 after the installing step.

The installing step may include straddling at least one opening 28 in a sidewall of the expansion device 22 with seals 44, 46 on the flow control device 42.

The flow control device 42 may prevent flow of the fluid 26, regulate flow of the fluid and/or filter the fluid after the installing step. One or more sensors 56 of the flow control device 42 may sense at least one property of the fluid 26 after the installing step.

The method may include the step of injecting a dilation fluid 32 into the formation 14, thereby reducing a pore pressure in the formation, increasing a pore pressure gradient in the formation and/or fluidizing the formation at a tip 30 of the inclusion 24. The dilation fluid 32 may have a viscosity greater than approximately 100 centipoise.

Of course, a person skilled in the art would, upon a careful consideration of the above description of representative embodiments of the invention, readily appreciate that many modifications, additions, substitutions, deletions, and other changes may be made to these specific embodiments, and such changes are within the scope of the principles of the present invention.

Accordingly, the foregoing detailed description is to be clearly understood as being given by way of illustration and example only, the spirit and scope of the present invention being limited solely by the appended claims and their equivalents.

What is claimed is:

1. A well system, comprising:

a casing expansion device interconnected in a casing string for initiating at least one inclusion propagated into a formation surrounding the casing string, the expansion device having at least one opening in a sidewall for fluid communication between the inclusion and an interior of the casing string, wherein the casing expansion device receives therein a flow control device which is detached from a conveyance device and fluidly sealed within the casing expansion device on opposite sides of the opening; and the flow control device retrievably installed in the expansion device, the flow control device controlling flow of fluid between the formation and an interior of the casing string.

2. The well system of claim 1, wherein the expansion device includes an internal latching profile for releasable engagement by the flow control device.

3. The well system of claim 1, wherein the flow control device prevents flow of the fluid through the opening.

4. The well system of claim 1, wherein the flow control device regulates flow of the fluid through the opening.

5. The well system of claim 1, wherein the flow control device filters the fluid which flows through the opening.

6. The well system of claim 1, wherein the flow control device includes at least one sensor which senses at least one property of the fluid.

7. The well system of claim 1, wherein the formation comprises weakly cemented sediment.

8. The well system of claim 1, wherein the inclusion is propagated into a portion of the formation having a bulk modulus of less than approximately 750,000 psi.

9. The well system of claim 1, wherein the formation has a cohesive strength of less than 400 pounds per square inch plus 0.4 times a mean effective stress in the formation at the depth of the inclusion.

10. The well system of claim 1, wherein the formation has a Skempton B parameter greater than $0.95\exp(-0.04\,p')+0.008\,p'$, where $p'$ is a mean effective stress at a depth of the inclusion.

11. A method of controlling flow of fluid between a formation and an interior of a casing string, the method comprising the steps of:

interconnecting a casing expansion device in the casing string;

expanding the expansion device to thereby initiate propagation of at least one inclusion into the formation; and installing a flow control device in the expansion device to thereby control flow of the fluid between the inclusion and the interior of the casing string, wherein the installing step comprises conveying the flow control device into the casing string via a conveyance device and detaching the conveyance device from the flow control device while the flow control device is received and fluidly sealed within the expansion device.

12. The method of claim 11, wherein the installing step is performed after the expanding step.

13. The method of claim 11, further comprising the step of retrieving the flow control device from the expansion device after the installing step.

14. The method of claim 11, wherein the installing step further comprises straddling at least one opening in a sidewall of the expansion device with seals on the flow control device.

15. The method of claim 11, wherein the flow control device prevents flow of the fluid after the installing step.

16. The method of claim 11, wherein the flow control device regulates flow of the fluid after the installing step.

17. The method of claim 11, wherein the flow control device filters the fluid after the installing step.

18. The method of claim 11, wherein at least one sensor of the flow control device senses at least one property of the fluid after the installing step.

19. The method of claim 11, wherein the formation comprises weakly cemented sediment.

20. The method of claim 11, wherein the formation has a bulk modulus of less than approximately 750,000 psi.

21. The method of claim 11, further comprising the step of injecting a dilation fluid into the formation, thereby reducing a pore pressure in the formation at a tip of the inclusion.

22. The method of claim 11, further comprising the step of injecting a dilation fluid into the formation, thereby increasing a pore pressure gradient in the formation at a tip of the inclusion.

23. The method of claim 11, further comprising the step of injecting a dilation fluid into the formation, thereby fluidizing the formation at a tip of the inclusion.

24. The method of claim 11, further comprising the step of injecting a dilation fluid having a viscosity greater than approximately 100 centipoise into the formation.

25. The method of claim 11, wherein the formation has a cohesive strength of less than 400 pounds per square inch plus 0.4 times a mean effective stress in the formation at a depth of the inclusion.

26. The method of claim 11, wherein the formation has a Skempton B parameter greater than $0.95\exp(+0.04\,p') + 0.008\,p'$, where $p'$ is a mean effective stress at a depth of the inclusion.

* * * * *